United States Patent [19]

Ohtsuka et al.

[11] Patent Number: 4,624,554

[45] Date of Patent: Nov. 25, 1986

[54] CHARGING AND EXPOSING HEAD FOR USE IN ELECTROPHOTOGRAPHIC APPARATUS

[75] Inventors: Shuichi Ohtsuka; Hiroshi Matsuoka; Yoshimitsu Sato, all of Kanagawa, Japan

[73] Assignee: Fuji Photo Film Co., Ltd., Ashigarakami, Japan

[21] Appl. No.: 786,335

[22] Filed: Oct. 10, 1985

[30] Foreign Application Priority Data

Oct. 22, 1984 [JP] Japan ..... 59-158346[U]

[51] Int. Cl.[4] ..... G03G 15/048; G03G 15/00

[52] U.S. Cl. ..... 355/64; 355/3 R; 355/3 CH; 355/16; 355/30

[58] Field of Search ..... 355/64, 3 R, 3 CH, 14 CH, 355/30, 16

[56] References Cited

U.S. PATENT DOCUMENTS

| | | | |
|---|---|---|---|
| 3,524,704 | 8/1970 | Turner | 355/64 X |
| 3,528,355 | 9/1970 | Blackert | 355/64 X |
| 3,824,011 | 7/1974 | Suzuki et al. | 355/64 X |
| 3,966,317 | 6/1976 | Wacks et al. | 355/64 X |
| 4,147,429 | 4/1979 | Lysle | 355/30 X |
| 4,198,156 | 4/1980 | Barker et al. | 355/30 |
| 4,202,618 | 5/1980 | Waschk et al. | 355/30 X |
| 4,413,897 | 11/1983 | Kohyama | 355/3 CH |
| 4,454,559 | 6/1984 | Shenoy | 355/3 CH X |

*Primary Examiner*—A. C. Prescott

*Attorney, Agent, or Firm*—Abelman Frayne Rezac & Schwab

[57] ABSTRACT

A charging and exposing head for use in an electrophotographic apparatus includes a charging and exposing chamber having a light transmission window for carrying out charging and exposing operation on an electrophotosensitive member moving along the light transmission window. In the charging and exposing head, a retaining member presses the electrophotosensitve member against the light transmission window to maintain the flatness of the electrophotosensitive member, and cooling air is supplied from a cooling gas supply pipe toward the electrophotosensitive member brought opposite to the light transmission window to prevent thermal deformation of the electrophotosensitive member.

4 Claims, 6 Drawing Figures

CHARGING AND EXPOSING HEAD FOR USE IN ELECTROPHOTOGRAPHIC APPARATUS

FIELD OF THE INVENTION

This invention relates to a process head for use in an electrophotographic apparatus for carrying out the steps of charging, exposure, development and fixing thereby recording picture image data on an electrophotographic film, and more particularly to a process head which carries out, at the same position, both the charing and exposing operation and the projecting operation projecting recorded picture image data onto a screen or the like.

BACKGROUND OF THE INVENTION

An electrophotographic apparatus is used for recording picture image data on an electrophotographic microfilm in the form of an electrophotosensitive member which is formed by laminating a layer of a transparent conductive material and a layer of a transparent photoconductive insulating material on a base of a transparent insulating material. The principle of recording picture image data on such a film by the electrophotographic apparatus includes the steps of uniformly electrostatically charging the film, exposing picture image data carried by an original onto the charged film to leave a pattern of electrical charges corresponding to the picture image data on the film, developing the residual charge pattern on the film with a charged toner, and finally fixing the toner image on the film. Thus, the picture image data are recorded by the processing steps of charging, exposure, development and fixing. Unlike a conventional silver-halide photographic film, the electrophotographic film used in this electrophotographic apparatus is featured in that it does not become photosensitive until it is electrostatically charged. Therefore, in the case of the electrophotographic apparatus, additional recording of new picture image data on non-recorded frames of the film can be very easily achieved by merely electrostatically charging the film immediately before the step of exposure as described above. In contrast, in the case of a conventional photographic apparatus using a silver-halide photographic film, additional recording of new picture image data on the film is almost impossible due to the difficulty of complete shielding of the film against light although this complete shielding is required at the time of film exchange, during storage and, especially, at the time of data retrieval before projection.

However, the charges provided by electrostatically charging the film used in the electrophotographic apparatus are lost by natural extinction in a very short period of time, and, therefore it is necessary to perform the steps of exposure and development before the charges on the film disappear. Thus, there is the requirement that the steps of charging, exposure and development should be completed within a short length of time. As a means of satisfying this requirement, a process head including a charging and exposing section, a developing section and a fixing section arranged in continuous series has been proposed so that the steps of charging and exposure, development and fixing can be simultaneously performed by the individual sections respectively of the process head on an electrophotographic film moving along the process head.

A practical form of such a process head will be described with reference to FIG. 6. FIG. 6 shows a charging and exposing chamber 1 and a developing chamber 2 only of the process head. Referring to FIG. 6, a corona discharge electrode 4 disposed in the charging and exposing chamber 1 radiates corona ions uniformly toward and onto an electrophotographic film 3 for uniformly electrostatically charging the film 3, and light condensed by a lens 5 is focused on the film 3 to expose the film 3 at the same position thereby forming a residual charge pattern corresponding to picture image data carried by an original. Subsequently, the film 3 is moved by a distance corresponding to one frame to bring the exposed frame into engagement with the developing chamber 2. In the developing chamber 2, a charged toner disposed in a liquid developer is supplied toward and onto the surface of the exposed frame of the film 3 thereby developing the residual charge pattern. In the process head shown in FIG. 6, a film retaining member 6 in the form of a flat plate is disposed for pressing the film 3 against the charging and exposing chamber 1 and the developing chamber 2 of the process head, so that the portion of the film 3 brought opposite to the charging and exposing chamber 1 can maintain the desired positional accuracy relative to the process head and is maintained as flat as possible and also so that the liquid developer may not externally leak from the developing chamber 2 through the portion of the film 3 brought opposite to the developing chamber 2. A condenser lens 7 and a projection lamp 8 for projecting the picture image data recorded already on the film 3 are disposed on the other side of the film retaining member 6, that is, on the side remote from the exposure lens 5 of the charging and exposing chamber 1. In an electrophotographic apparatus including the process head having such a structure, the charging and exposing chamber 1 has the functions of charging, exposure and projection. The electrophotographic process head of the above type is described in detail in, for example, Japanese unexamined Patent Publication No. 59-100479(1984). Also, an apparatus using a process head similar to that described above for carrying out, at the same position, the charging and exposing operation and the projecting operation projecting recorded picture image data is disclosed in the applicant's earlier applications, for example, Japanese Patent Applications Nos. 58-84079, 58-173869 and 58-173870 (1983).

In the process head of the aforementioned structure, the charging and exposure of a film and the projection of recorded picture image data are carried out in the same chamber. Therefore the entire film cannot be supported by a member such as a glass plate. As a result, in the projection mode in which the luminous intensity of projection light is as high as about 100,000 luxes, the film cannot maintain its flatness due to thermal deformation attributable to the temperature rise, and out of focusing results necessarily. The desired flatness of the film may be maintained when a vacuum-sucked plate is employed to serve as the film retaining member 6. However, employment of such a plate results in a bulky overall size of the apparatus, and the apparatus becomes quite expensive. Also, when the film is to be loaded in a cassette, the vacuum-sucked plate must also be incorporated in the cassette, resulting in a bulky overall size of the cassette. Further, the desired flatness of the film may be maintained when a projection chamber is separately provided. However, this results in the loss of the desired compactness of the process head.

BRIEF SUMMARY OF THE INVENTION

It is a primary object of the present invention to provide a charging and exposing head for use in an electrophotographic apparatus, which head can carry out the charging and exposing operation and the projecting operation at the same position without causing thermal deformation of a film in the projection mode, thereby maintaining the desired flatness of the film and preventing out of focusing when the head operates in the projection mode.

In accordance with the present invention which attains the above object, there is provided a charging and exposing head for use in an electrophotographic apparatus including a charging and exposing chamber having a light transmission window for carrying out charging and exposing operation on electrophotosensitive member moving along the light transmission window, the head comprising a cooling gas supply pipe connected to the charging and exposing chamber for supplying cooling gas toward the electrophotosensitive member brought opposite to the light transmission window so as to prevent thermal deformation of the electrophotosensitive member during projection of picture image data recorded on the electrophotosensitive member onto a screen by projection light directed from a light source, and a retaining member disposed opposite to the light transmission window for pressing the electrophotosensitive member against the light transmission window so as to maintain the flatness of the electrophotosensitive member in the projection mode, whereby the electrophotosensitive member retained by the retaining member maintains its flatness, and the electrophotosensitive member cooled by the cooling gas is prevented from thermal deformation.

DETAILED DESCRIPTION OF THE PREFERRED EMBODIMENT

A preferred embodiment of the present invention will now be described in detail with reference to FIGS. 1 to 5.

Figure 1:
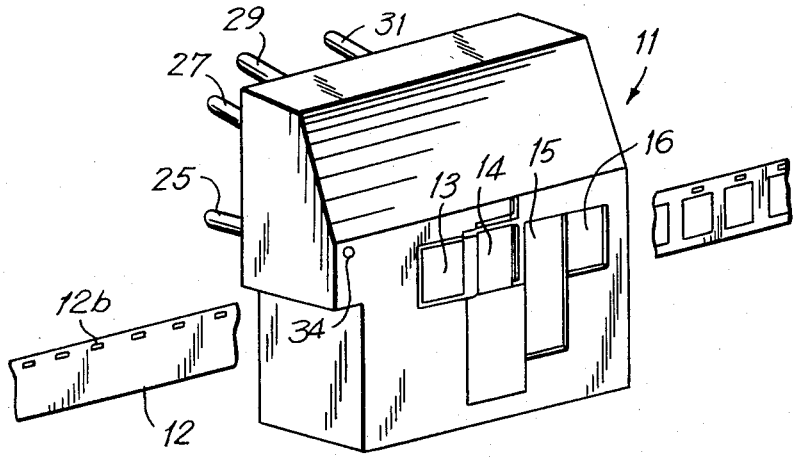
FIG. 1 is a general perspective view of a processed incorporated in an electrophotographic apparatus and including an embodiment of the charging and exposing head according to the present invention.
Figure 2:
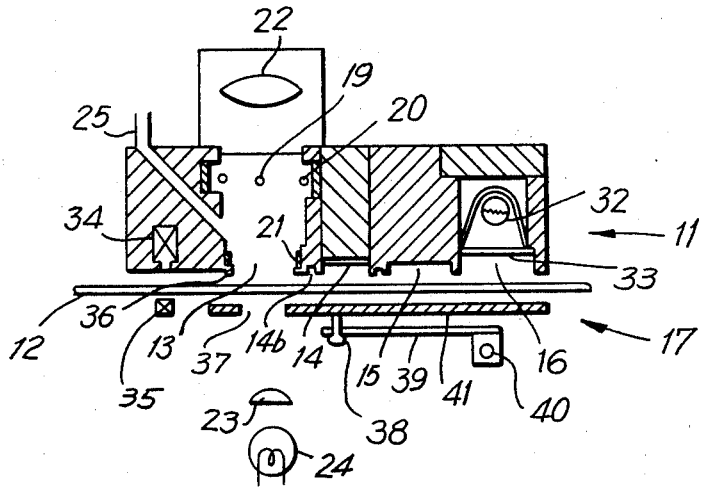
FIG. 2 is a sectional, plan view of the process head.

Referring to FIGS. 1 and 2, a process head 11 for use in an electrophotographic apparatus is of a one-piece type having incorporated therein four processing chambers carrying out the steps of charging-exposing, developing, drying and fixing respectively. A charging and exposing chamber 13, a developing chamber 14, a drying chamber 15 and a fixing chamber 16 each having a window of a size corresponding to one frame of an electrophotographic film 12, which is an electrophotosensitive member, are arranged in continuous series to be respectively opposed by individual frames of the electrophotographic film 12. The electrophotographic film 12 is pressed by a film retaining member 17 against rim 36 of front openings of windows of the individual processing chambers, and the electrophotographic film 12 thus maintained flat moves along the individual processing chambers to be successively processed.

The film retaining member 17 must have the function of bringing the electrophotosensitive surface 12*a* (see FIG. 3) of the electrophotographic film 12 into intimate engagment with the rim 36 of the opening of the charging and exposing chamber 13 thereby accurately maintaining the distance between a lens (described later) and the film 12. Also, the film retaining member 17 must have a high permeability to light so that projection light emitted from a light source 24 can pass therethrough to be toward the film surface in the projection mode. For this purpose, the film retaining member 17 may be formed of a material such as glass or an acrylic resin having a satisfactory transmittion factor. Also, the film retaining member 17 may be in the form of a plate of, for example, a metal or a resin which is cut out at the portion required for irradiation of the film 12 at the position the charging and exposing chamber 13. When a portion of projection light of high luminous intensity leaks for a large length of time to irradiate non-recorded frames adjacent to the frame of the film 12 brought into intimate engagement with the charging and exposing chamber 13 in the projection mode, the sensitivity and other characteristics of the film 12 will be degraded. To avoid such an objectionable phenomenon, the film retaining member 17 has preferably a masking function to prevent leakage of unnecessary light so that the required portion only of the film 12 can be irradiated.

Figure 5:
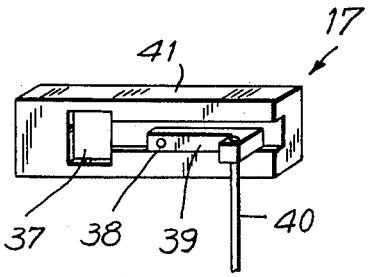
FIG. 5 is a perspective view of the film retaining member associated with the charging and exposing head.
Figure 6:
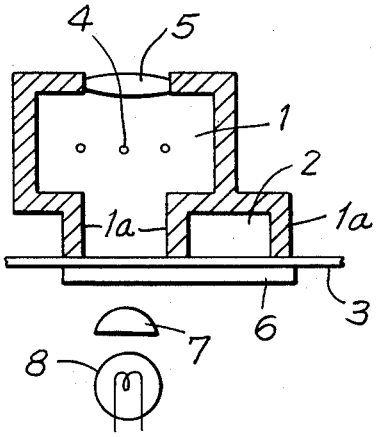
FIG. 6 is a sectional, plan view of part of a prior art process head.

As shown in FIG. 5, the film retaining member 17 includes a retaining plate 41 which is formed of an opaque material such as a metal and is provided with a window 37 permitting transmission of projection light therethrough. At least two sides of this window 37 are smaller in length than those of the rim 36 of the opening of the charging and exposing chamber 13, so that the film 12 can be brought into intimate engagement with the rim 36 of the opening by the retaining plate 41. The retaining plate 41 is fixed by a pin 38 to an arm 39 fixed to a rotatable shaft 40 rotated by a motor or a solenoid (not shown), so that the head-side surface of the retaining plate 41 can be easily positioned parallel to the associated surface of the rim 36 of the opening of the charging and exposing chamber 13. Further, to prevent accidental rotation of the retaining plate 41 due to the one-point support, a groove having a width approximately equal to that of the arm 39 is formed in the area of the retaining plate 41 adjacent to the pin 38 by which the retaining plate 41 is fixed to the arm 39.

Figure 3:
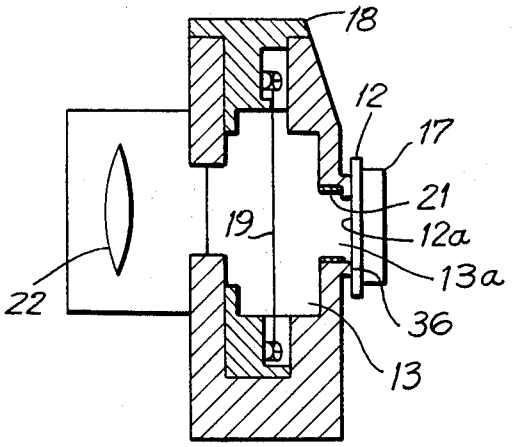
FIG. 3 is a sectional, side elevation view of the charging and exposing head.

The charging and exposing chamber 13 is formed in a charging and exposing head 18. This charging and exposing head 18 includes a corona wire 19, corona electrodes 20 and a mask electrode 21 for electrostatically charging the electrophotographic film 12, and a lens 22 for focusing picture image data onto the charged electrophotographic film 12, thereby forming and electrostatic latent image of the picture image data on the electrophotosensitive surface 12*a* of the electrophotographic film 12 pressed against a light transmission window 13*a* of the charging and exposing chamber 13 as shown in FIG. 3. On the other side of the charging and exposing chamber 13, that is, on the side remote from the lens 22 relative to the film retaining member 17, a condenser lens 23 and a projection lamp 24 are disposed for projecting picture image data already recorded on the electrophotographic film 12. A cooling gas supply pipe 25 for supplying cooling gas such as air from a supply source (not shown) toward and onto the electrophotosensitive surface 12*a* of the electrophotographic film 12 in the picture image data projection mode is connected to the charging and exposing chamber 13. Thus, in the projection mode, the electrophotographic film 12 is maintained flat by the film retaining member 17 and, at the same time, its thermal deformation is prevented by the cooling gas supplied by way of the cooling gas supply pipe 25.

Figure 4:
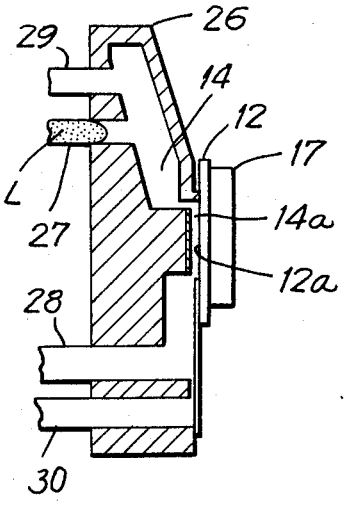
FIG. 4 is a sectional, side elevation view of the developing head in the process head.

The developing chamber 14 is formed in a developing head 26 as shown in FIG. 4. Connected to the developing chamber 14 are a liquid developer supply pipe 27 for supplying a toner-dispersed liquid developer L into the developing head 26 and a liquid developer discharge pipe 28 for discharging the used liquid developer L from the developing head 26. The liquid developer L is supplied to toner-develop the electrostatic latent image formed on the electrophotosensitive surface 12*a* of the electrophotosensitive film 12. Further, a requesting gas supply pipe 29 is connected for supplying squeezing gas such as air from a supply source (not shown) into the developing head 26, so that any excess of the liuqid developer L attaching to the electrophotosensitive surface 12*a* can be removed by being squeezed by the squeezing gas. Further, a suction pipe 30 communicating between a vacuum source (not shown) and a suction chamber 14*b* formed outside the developing chamber 14 is connected to the developing chamber 14, so that any portion of the liquid developer L which way leak out from the associated edge portions of the electrophotographic film 12 pressed against a window 14*a* of the developing chamber 14 may not spread toward other areas.

The drying chamber 15 is connected by a drying gas supply pipe 31 to a supply source (not shown). Drying gas such as air supplied by way of the supply pipe 31 is flown onto the electrophotographic film 12 pressed against a window of the drying chamber 15 for drying the electrophotosensitive surface 12*a* wetted with the liquid developer L.

A flash lamp 32 such as a xenon lamp is disposed in the fixing chamber 16 to fuse and fix the toner carried by the electrophotosensitive surface 12*a* so that the toner image of the recorded picture image data can be semi-permanently preserved on the film surface. A light-permeable member 33 such as a glass sheet or a transparent plastic film is disposed between the flash lamp 32 and the electrophotographic film 12 so that any matter vaporized during the step of fixing may not attach to the flash lamp 32.

The process head 11 is provided with a blip sensor 34 which receives light emitted from a sensor-irradiating light source 35 disposed on the other side of the electrophotographic film 12. This blip sensor 34 senses blip marks 12*b* provided on the electrophotographic film 12 so as to control the retrieval of the desired frame. Thus, when, for example, the electrophotographic film 12 which may be a 16-mm film is moved stepwise over a distance corresponding to one frame and is then stopped, the steps of charging-exposing, development, drying and fixing are executed in parallel relation, so that the time interval required for processing each of individual frames can be shortened.

In the projection mode in which picture image data already recorded on the electrophotographic film 12 are projected at the position of the charging and exposing chamber 13 of the process head 11 having the structure described above, the electrophotographic film 12 is irradiated with light of high luminous intensity directed from the projection lamp 24 through the condenser lens 23. However, the cooling gas supplied by way of the cooling gas supply pipe 25 cools the electrophotographic film 12 to prevent undesirable thermal deformation of the film 12. Since, at the same time, the electrophotographic film 12 is pressed against the light transmission window 13*a* of the charging and exposing chamber 13 by the film retaining member 17, the desired flatness of the film 12 is sufficiently maintained without giving rise to out of focusing during projection.

In the present invention, the cooling gas is preferably directed substantially toward the center of the rim 36 of the opening of the charging and exposing chamber 13. It is effective to supply the cooling gas at a flow rate of 1 /min or more per 1 cm of the area of the opening of the rim 36, or, more preferably, at a flow rate of 3l/min or more. Although the cooling gas may be supplied continuously throughout the period of projection, it is preferable that the cooling air is supplied during only the period of time in which the electrophotographic film 12 is pressed against the rim 36 by the film retaining member 17, but the supply of the cooling gas is stopped when the film retaining member 17 is released from the retaining action. This manner of cooling gas supply provides such another advantage that generation of noise due to vibration of the film 12 can be prevented.

The head according to the present invention will now be compared with a prior art head which does not employ the arrangement of the present invention. When an electrophotographic film was irradiated with projection light having a luminous intensity of, for example, 400,000 luxes at the film surface in the prior art head, the film was subjected to a thermal deformation of about 100 μm in 5 to 15 minutes, and the resolution on a screen was reduced to a value less than 2 lines/mm. On the other hand, when the same electrophotographic film was irradiated under the same conditions in the head of the present invention while supplying cooling gas at a flow rate of 3 l/min toward the film surface and pressing the film against the entire rim of the opening by the film retaining member with the force of 200 grams, it was confirmed that the resolution on the screen could be maintained at a value larger than 4.5 lines/mm.

The aforementioned embodiment has referred to application of the present invention to a four-frame process head consisting of a charging and exposing head, a developing head, a drying head and a fixing head. However, the present invention is in no way limited to such a process head and is also equally effectively applicable to any charging and exposing head in a process head for an electrophotogrpahic apparatus insofar as the charging and exposing operation and the projecting operation are carried out at the same position. In the aforementioned embodiment, the light source 24 and the condenser lens 23 for projection purpose are disposed to direct projection light from the film-side of the charging and exposing chamber 13. However, the positions of the condenser lens 23 and the light source 24 relative to the position of the lens 22 may be reversed so that projection light passes through the charging and exposing chamber 13 to irradiate the electrophotographic film 12.

It will be understood from the foregoing detailed description of the present invention that, in a charging and exposing head for use in an electrophotographic apparatus, which head is constructed to carry out the charging and exposing operation and the projecting operation at the same position, cooling gas is supplied toward an electrophotographic film, and the film is pressed against the rim of a light transmission window by a film retaining member in the projection mode, so that the film is not subjected to thermal deformation and can maintain its flatness. Thus, the film irradiated with light of high luminance intensity in the projection mode can maintain its flatness without being thermally deformed, so that out of focusing can be prevented.

While a preferred embodiment has been described, variations thereto will occur to those skilled in the art within the scope of the present inventive concepts which are delineated by the following claims.

We claim:

1. A charging and exposing head for use in an electrophotographic apparatus including a charging and exposing chamber having a light transmission window for carrying out charging and exposing operation on an electrophotosensitive member moving along said light transmission window, said head comprising a cooling gas supply conduit connected to said charging and exposing chamber for supplying cooling gas toward the electrophotosensitive member brought opposite to said light transmission window so as to prevent thermal deformation of the electrophotosensitive member during projection of picture image data recorded on the electrophotosensitive member onto a screen by projection light directed from a light source, and a retaining member disposed opposite to said light transmission window for pressing the electrophotosensitive member against said light transmission window so as to maintain the flatness of the electrophotosensitive member in the projection mode.

2. A charging and exposing head as claimed in claim 1, wherein said cooling gas supply pipe is a cooling air supply pipe.

3. A charging and exposing head as claimed in claim 1, wherein the outlet of said cooling gas supply pipe is directed toward substantially the center of said light transmission window of said charging and exposing chamber, and said cooling gas supply pipe supplies the cooling gas at a flow rate of 1 liter/min or more, preferably, 3 liter/min or more, per 1 $cm^2$ of said light transmission window.

4. A charging and exposing head as claimed in claim 1, wherein said retaining member is formed of a metal and is provided with a projection light transmission window.

* * * * *